US007830102B2

(12) United States Patent
Huang et al.

(10) Patent No.: US 7,830,102 B2
(45) Date of Patent: Nov. 9, 2010

(54) LIGHT SOURCE DRIVING DEVICE

(75) Inventors: Wei-Chi Huang, Taipei Hsien (TW); Chi-Hsiung Lee, Taipei Hsien (TW)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 350 days.

(21) Appl. No.: 12/100,426

(22) Filed: Apr. 10, 2008

(65) Prior Publication Data

US 2008/0252231 A1 Oct. 16, 2008

(30) Foreign Application Priority Data

Apr. 10, 2007 (TW) ..... 96112576 A

(51) Int. Cl.
*G05F 1/00* (2006.01)

(52) U.S. Cl. ..... 315/307; 315/209 R; 315/177

(58) Field of Classification Search ..... 315/177, 315/185 R, 192, 193, 209 R, 210, 220, 224, 315/225, 246, 250, 254, 276, 277, 279, 282, 315/287, 291, 297, 299, 301, 306, 307, 308, 315/312, 313, 320
See application file for complete search history.

(56) References Cited

U.S. PATENT DOCUMENTS

2004/0080273 A1* 4/2004 Ito et al. ..... 315/77
2008/0067944 A1* 3/2008 Wang et al. ..... 315/185 R

FOREIGN PATENT DOCUMENTS

TW 200533246 10/2005

* cited by examiner

*Primary Examiner*—Douglas W Owens
*Assistant Examiner*—Jianzi Chen
(74) *Attorney, Agent, or Firm*—Frank R. Niranjan

(57) ABSTRACT

A light source driving device for driving a light source module (22), includes a power stage circuit (20), a transformer and resonance circuit (21), a current balancing circuit (23), a feedback control circuit (25) and an fault detecting circuit (24). The power stage circuit converts received signals to alternating current (AC) signals. The transformer and resonance circuit converts the AC signals to electrical signals. The current balancing circuit balances current flowing through the light source module. The fault detecting circuit comprises a plurality of inputs (a1), (a2*n* (n=1, 2, 3, . . . , n)) and an output (b1). One of inputs is connected to one input of the current balancing circuit, other inputs are connected to outputs of the current balancing circuit, and the output outputs a fault signal. The feedback control circuit is used for controlling output of the power stage circuit.

7 Claims, 6 Drawing Sheets

LIGHT SOURCE DRIVING DEVICE

BACKGROUND

1. Field of the Invention

The invention relates to light source driving devices, and particularly to a light source driving device with a fault detecting function.

2. Description of Related Art

Conventionally, discharge lamps, such as Cold Cathode Fluorescent Lamps (CCFLs), External Electrode Fluorescent Lamps (EEFLs), need inverters. Normally, in order to protect the inverter, each inverter comprises a fault detecting circuit to detect whether the discharge lamps are faulty.

FIG. 6 is a conventional light source driving device with an fault detecting function. A power stage circuit 10 converts a received signal to an alternating current (AC) signal. The AC signal is converted to a sine-wave signal to drive lamps L11, L12 via a resonance circuit composed of a transformer T and a capacitor C. A current balancing circuit 11 is connected to the lamps L11 and L12, for balancing current flowing through the lamps L11 and L12 and outputting a current feedback signal. A fault detecting circuit 12 is connected to a low voltage end of a secondary winding of the transformer T, for detecting whether the lamps L11 and L12 are faulty and outputting a fault signal. A feedback control circuit 13 is connected between the current balancing circuit 11, the fault detecting circuit 12, and the power stage circuit 10, for controlling output of the power stage circuit 10 according to the current feedback signal and the fault signal.

In fact, the fault signal output from the fault detecting circuit 12 is a current signal transmitted to the low voltage end of the secondary winding of the transformer T via the current balancing circuit 11. However, the current signal may be attenuated by the current balancing circuit 11, and the attenuated current signal is what is detected by the fault detecting circuit 12 at the low voltage end of the secondary winding of the transformer T. Then, the fault detecting circuit 12 compares the attenuated current signal to a predetermined current signal, which leads to unreliable detection of faults. Therefore, the light source driving device can not exactly determine whether the lamps L11 and L12 are faulty.

SUMMARY

One aspect of the invention provides a light source driving device for driving a plurality of light sources, and comprises a power stage circuit, a transformer and resonance circuit, a current balancing circuit, a feedback control circuit, and a fault detecting circuit. The power stage circuit converts received signals to alternating current (AC) signals. The transformer and resonance circuit is connected between the power stage circuit and the light source module, for converting the AC signals to electrical signals adapted for driving the light sources. The current balancing circuit is connected to the light source module, for balancing current flowing through the light source module. The feedback control circuit is connected between the current balancing circuit and the power stage circuit, for controlling output of the power stage circuit according to the current flowing through the light source module. The fault detecting circuit comprises a plurality of inputs and an output, for detecting whether the light source module is faulty. One input of the fault detecting circuit is connected to one of inputs of the current balancing circuit, other inputs of the fault detecting circuit are connected to an output of the current balancing circuit, and the output of the fault detecting circuit outputs a fault signal to the feedback control circuit.

Other advantages and novel features will become more apparent from the following detailed description when taken in conjunction with the accompanying drawings, in which:

DETAILED DESCRIPTION OF THE EMBODIMENTS

Figure 1:
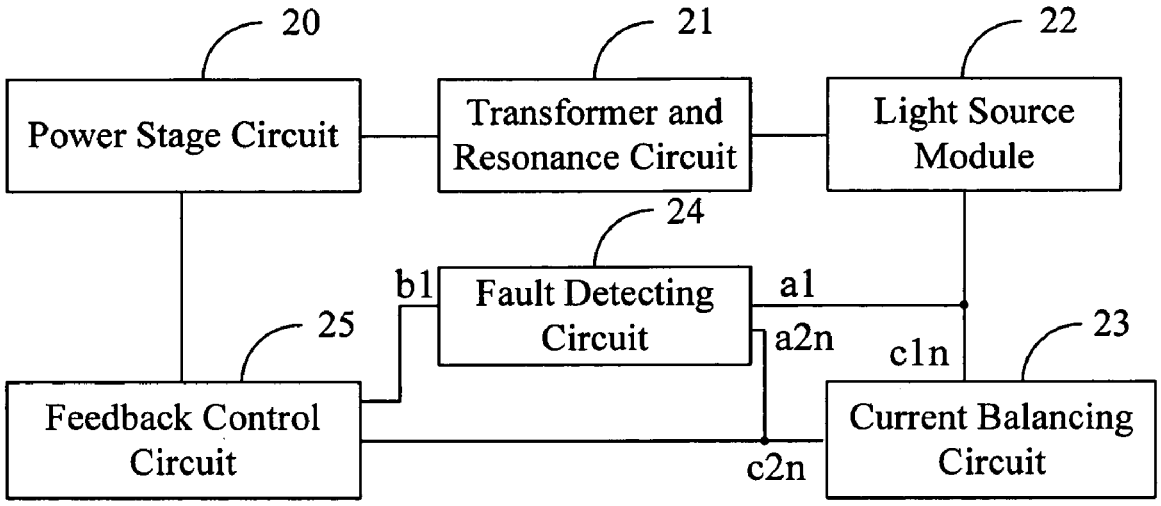
FIG. 1 is a block diagram of a light source driving device in accordance with a first exemplary embodiment of the invention, the light source driving device including a power stage circuit, a transformer and resonance circuit, a light source module, a current balancing circuit, a fault detecting circuit, and a feedback control circuit.

FIG. 1 is a block diagram of a light source driving device for driving a plurality of light sources of a light source module 22 in accordance with an exemplary embodiment of the invention. The driving device comprises a power stage circuit 20, a transformer and resonance circuit 21, a current balancing circuit 23, a fault detecting circuit 24, and a feedback control circuit 25. The power stage circuit 20 converts received signals to alternating current (AC) signals. The transformer and resonance circuit 21 is connected to the power stage circuit 20, for converting the AC signals to electrical signals adapted for driving the light source module 22. In the exemplary embodiment, the electrical signals are sine-wave signals. The current balancing circuit 23 is connected to the light source module 22, for balancing current flowing through the light sources. The fault detecting circuit 24 has a plurality of inputs a1 and a2*n* (n=1, 2, 3, . . . , n) and an output b1, for detecting whether the light sources are faulty. In the exemplary embodiment, one input a1 of the fault detecting circuit 24 is connected to one of inputs c1*n* (n=1, 2, 3, . . . , n) of the current balancing circuit 23, other inputs a2*n* (n=1, 2, 3, . . . , n) of the fault detecting circuit 24 are respectively connected to outputs c2*n* (n=1, 2, 3, . . . , n) of the current balancing circuit 23, and the output b1 of the fault detecting circuit 23 outputs a fault signal to the feedback control circuit 25. The fault signal comprises an over current signal, lamp broken signal and so on. The feedback control circuit is connected between the fault detecting circuit, the current balancing circuit and the power stage circuit, for controlling output of the power stage circuit 20 according to current flowing through the light sources and the fault signal.

Figure 2:
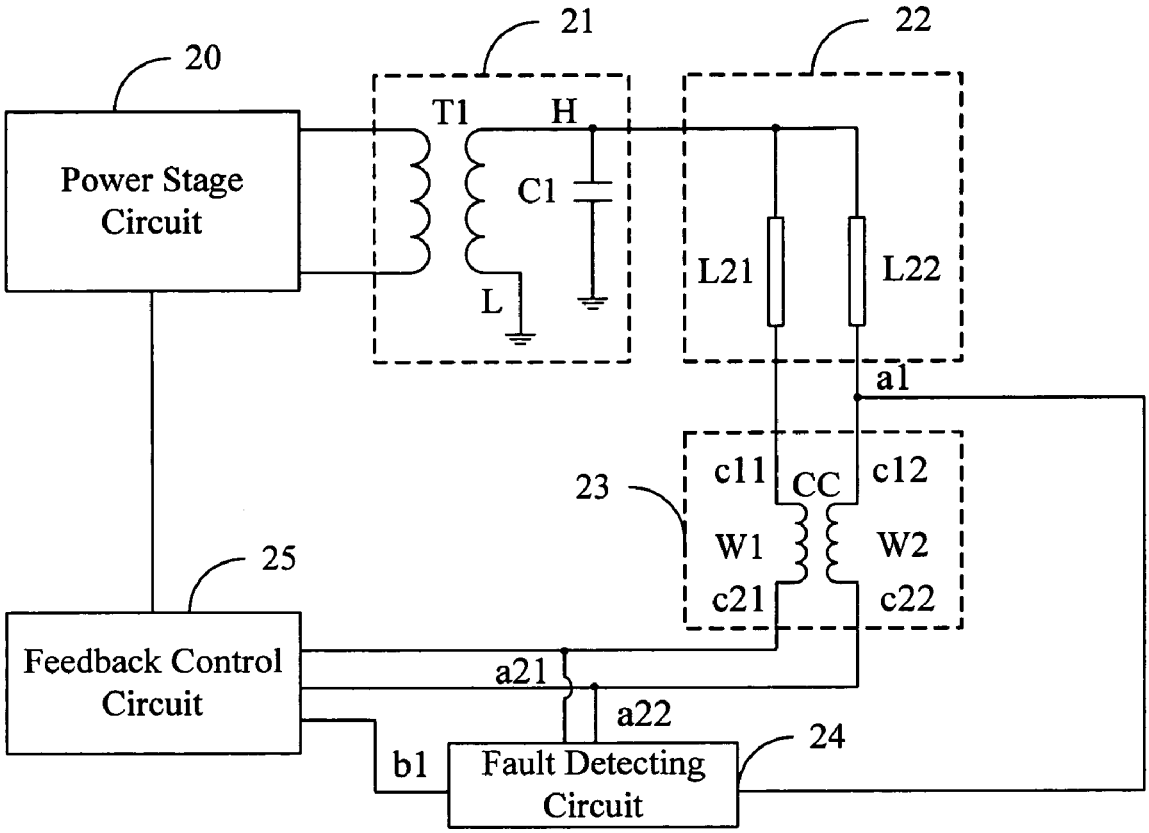
FIG. 2 is similar to FIG. 1 but showing schematic details of the transformer and resonance circuit, the light source module, and the current balancing circuit of FIG. 1.

FIG. 2 is a detailed circuit diagram of the transformer and resonance circuit 21, the light source module 22, and the current balancing circuit 23 of FIG. 2. The transformer and resonance circuit 21 comprises a transformer T1 and a resonance capacitor C1. The transformer T1 comprises a primary winding and a secondary winding. The primary winding of the transformer T1 is connected to the power stage circuit 20, and a low voltage end L of the secondary winding of the transformer T1 is grounded. The resonance capacitor C1 is connected between a high voltage end H of the secondary winding of the transformer T1 and ground. The light source module 22 comprises lamps L21, L22. High voltage ends of the lamps L21 and L22 are connected to the high voltage end H of the secondary winding of the transformer T1. The current balancing circuit 23 comprises windings W1 and W2, which are connected to low voltage ends opposite to the high voltage end of the lamps L21, L22 respectively, and to the feedback control circuit 25, for balancing current flowing through the lamps L21 and L22. In the exemplary embodiment, the inputs a1 and a21, a22 of the fault detecting circuit 24 are connected to the corresponding low voltage ends of the lamps L21, L22 and low voltage ends c21, c22 of the winding W1, W2. The output b1 of the fault detecting circuit 24 is connected to the feedback control circuit 25, for detecting whether the lamps L21 and L22 are faulty.

Figure 3:
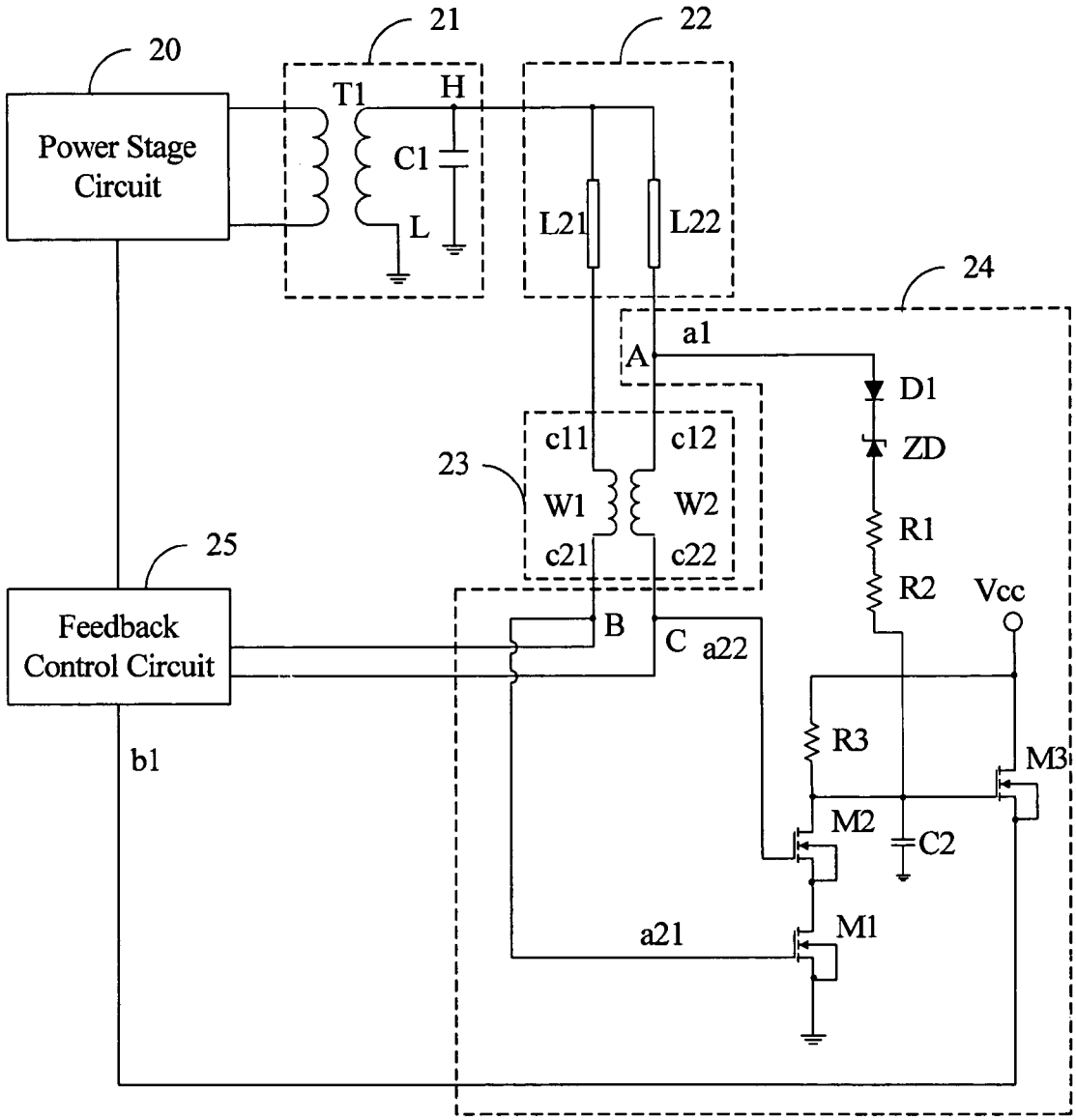
FIG. 3 is similar to FIG. 2 but also showing schematic details of the fault detect circuit of FIG. 1.

FIG. 3 is a detailed circuit diagram of the fault detecting circuit 24 of FIG. 2. The fault detecting circuit 24 comprises a bias resistor R3, a capacitor C2, and switching components M1, M2 and M3. In the exemplary embodiment, the switching components M1, M2 and M3 are Metallic Oxide Semiconductor Filed Effect Transistor (MOSFET). In this embodiment, the switching component M3 is defined as a primary switching component, and the switching components M1 and M2 are defined as secondary switching components.

In the exemplary embodiment, the base of the switching component M3 is electronically connected to the one input a1 of the fault detecting circuit 24, which is connected to the low voltage end of the lamp L22. The drain of the switching component M3 is connected to a power source Vcc. The source of the switching component M3 is electronically connected to the output b1 of the fault detecting circuit 24, which is connected to the feedback control circuit 25. The voltage of the power source Vcc is approximately 5V. The bases of the switching components M1 and M2 are respectively connected to the other inputs a21 and a22 of the fault detecting circuit 24, which are correspondingly connected to the low voltage ends c21 and c22 of the winding W1 and W2. The source of the switching component M1 is grounded, and the drain of the switching component M1 is connected to the base of the switching component M2. The drain of the switching component M2 is connected to the base of the switching component M3 and to the power source Vcc via the bias resistor R3. The capacitor C2 is connected between the base of the switching component M3 and ground.

In the exemplary embodiment, the fault detecting circuit 24 further comprises a diode D1, a zener diode ZD, and resistors R1 and R2. The anode of the diode D1 is connected to the low voltage end of the lamp L22, and the cathode of the diode D1 is connected to the cathode of the zener diode ZD. An anode of the zener diode ZD is connected to the base of the switching component M3 via the resistors R1 and R2, which are connected in series.

In the exemplary embodiment, when the lamps L21 and L22 are normal, that is, current flowing through the lamps L21, L22 and voltage applied to the lamps L21, L22 are normal, nodes B and C are high voltage level. Thus, the switching component M1 and M2 are on, and the switching component M3 is off. Therefore, the fault detecting circuit 24 outputs a low voltage level, that is, the fault detecting circuit 24 has no signal output to the feedback control circuit 25, and the driving device works normally.

When either or both of the lamps L21, L22 is faults, such as over current, lamp broken and so on, voltage level of node A is pulled high by the windings W1 and W2, and then, the voltage levels of the nodes B and C are pulled down to low voltage level. Therefore, the capacitor C2 is charged by the voltage of the node A via the diode D1, the zener diode ZD, and the resistors R1 and R2. Because the voltage level of the node A is relatively high, the capacitor C2 reaches saturation quickly, turning the switching component M3 on quickly, thus quickly turning off the driving device to protect the driving device.

In the exemplary embodiment, the resistors R1 and R2 are used for limiting current, and setting a charging time of the capacitor C2.

Figure 4:
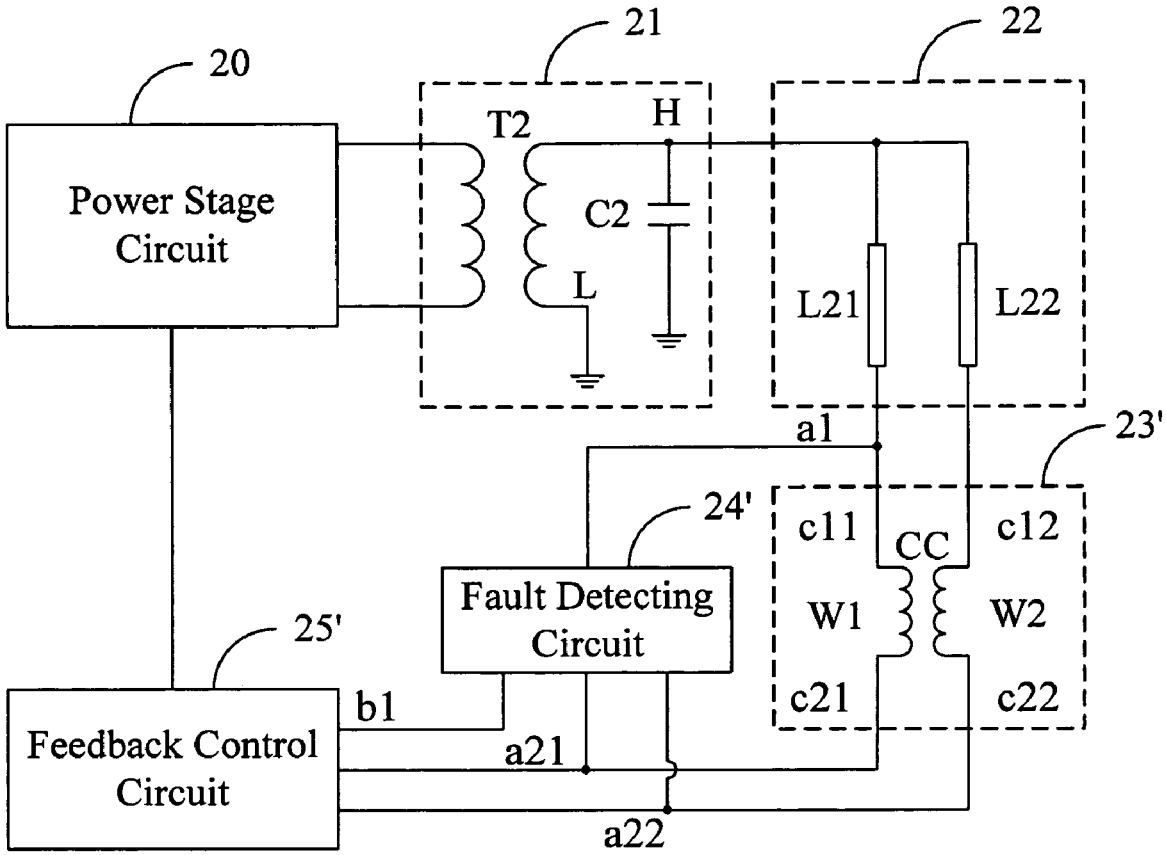
FIG. 4 is similar to FIG. 2 but showing a light source driving device in accordance with a second exemplary embodiment of the invention.

FIG. 4 is a light source driving device in accordance with a second exemplary embodiment of the invention, which is substantially the same as the driving device of FIG. 2, the difference is that one input a1 of a fault detecting circuit 24' is connected to the low voltage end of the lamp L21, and the output b1 of the fault detecting circuit 24' is connected to a feedback control circuit 25'. In the exemplary embodiment, the detailed circuit and working principle of the fault detecting circuit 24' are the same as those of the fault detecting circuit 24 of FIG. 2, and so is omitted.

Figure 5:
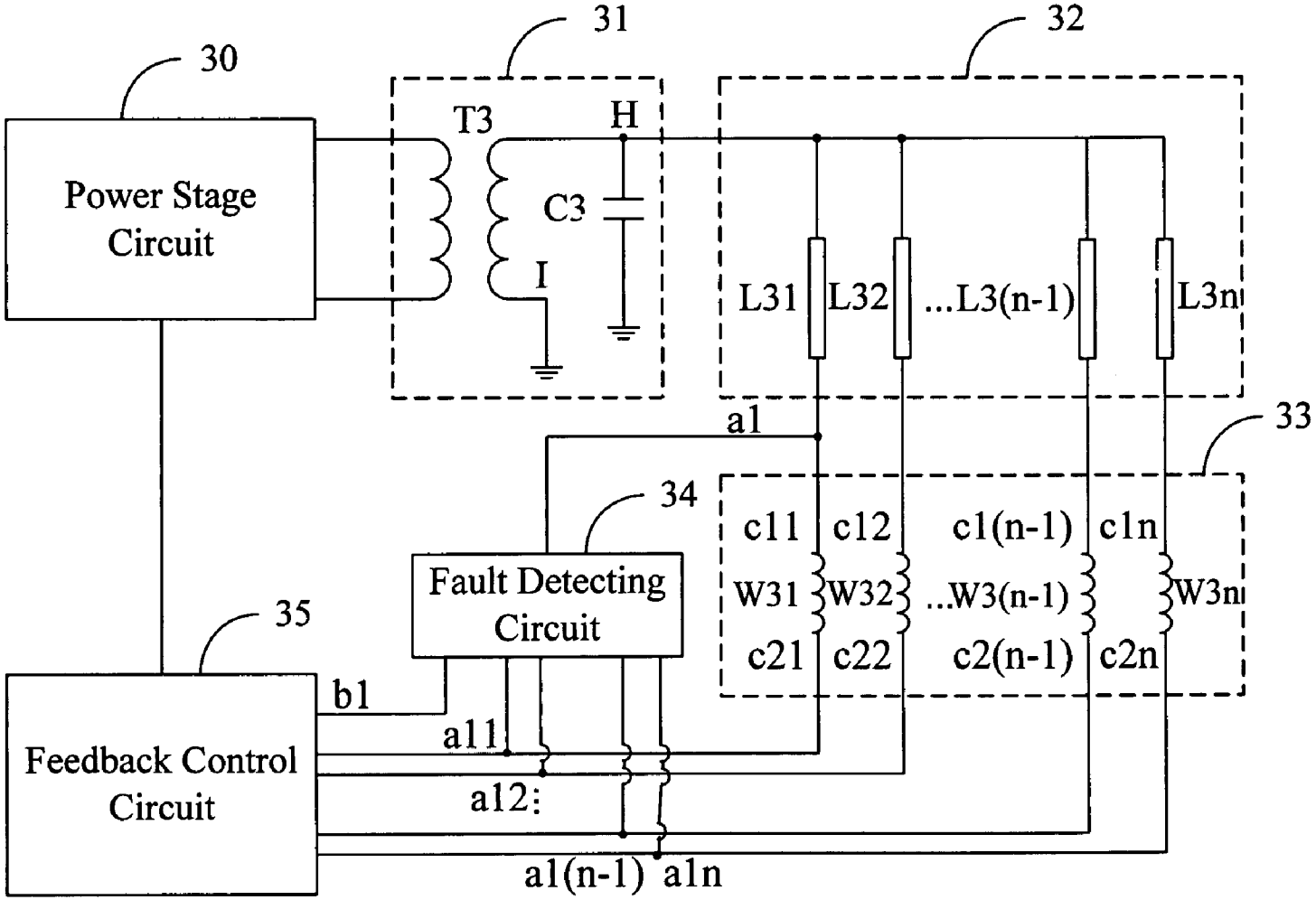
FIG. 5 is similar to FIG. 2 but showing a light source driving device in accordance with a third exemplary embodiment of the invention.
Figure 6:
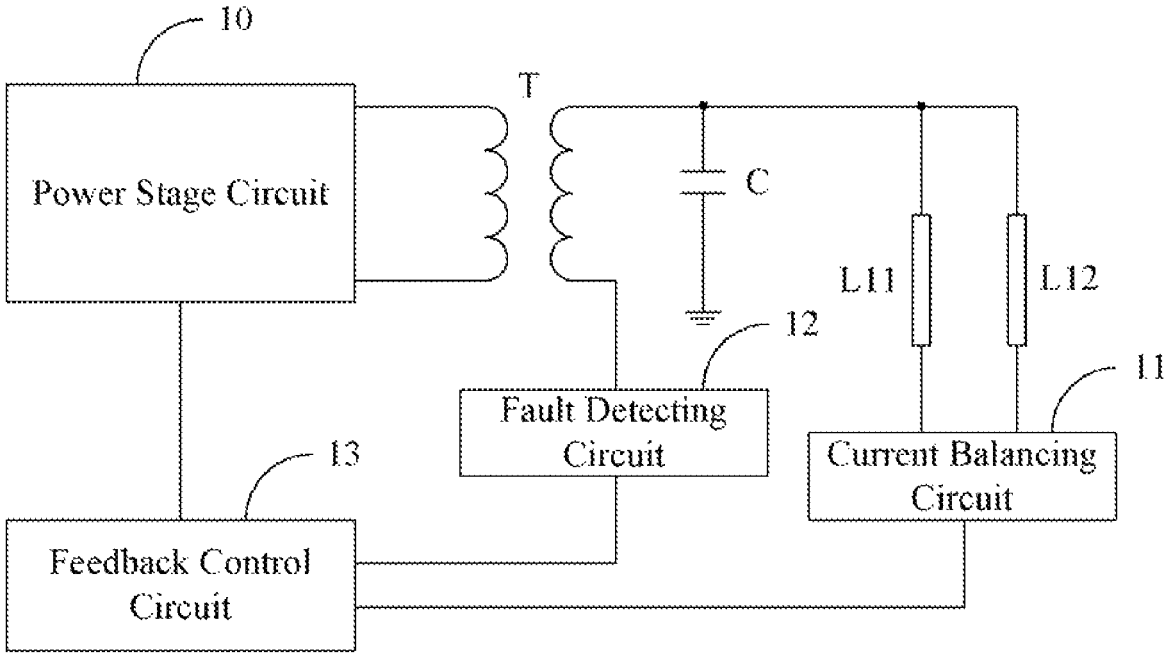
FIG. 6 (Related Art)
FIG. 6 is a conventional light source driving device.

FIG. 5 is a light source driving device in accordance with a third exemplary embodiment of the invention. A transformer and resonance circuit 31 comprises a transformer T3 and a resonance capacitor C3. Connections between the transformer T3 and the resonance capacitor C3 are the same as those of the transformer T1 and the resonance capacitor C1 of FIG. 2. In the exemplary embodiment, a light source module 32 comprises a plurality of lamps 3*n* (n=1, 2, 3, . . . , n), and a current balancing circuit 33 comprises a plurality of windings W3*n* (n=1, 2, 3, . . . , n). High voltage ends of the lamps 3*n* (n=1, 2, 3, . . . , n) are jointly connected to a high voltage end H of a secondary winding of a transformer T3, and low voltage ends thereof are connected to the feedback control circuit 35 via corresponding windings W3*n* (n=1, 2, 3, . . . , n). In the exemplary embodiment, an input a1 of the fault detecting circuit 34 is connected to the lamp L31, and an output b1 of the fault detecting circuit 34 is connected to the feedback control circuit 35. In other embodiments, the input a1 of the fault detecting circuit 34 is connected to a low voltage end of other lamps, and not the lamp L31.

In the present invention, one input of a fault detecting circuit is connected between a light source module and a current balancing circuit, which improves response time and prevents false readings.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments.

What is claimed is:

1. A light source driving device for driving a plurality of light sources, comprising:

a power stage circuit, for converting received signals to alternating current (AC) signals;

a transformer and resonance circuit, connected between the power stage circuit and the light sources, for converting the AC signals to electrical signals adapted for driving the light sources;

a current balancing circuit, connected to the light sources, for balancing currents flowing through the light sources;

a fault detecting circuit comprising a plurality of inputs and an output, for detecting whether one or more of the light sources is faulty; wherein one input of the fault detecting circuit is connected to one input of the current balancing circuit, other inputs of the fault detecting circuit are connected to outputs of the current balancing circuit, and the output of the fault detecting circuit outputs an fault signal, wherein the fault detecting circuit comprising:

a primary switching component comprising a base, a drain and a source, wherein the base of the primary switching component is electronically connected to one input of the fault detecting circuit, the drain of the primary switching component is connected to a power source, and the source of the primary switching component is defined as the output of the fault detecting circuit;

a plurality of secondary switching components each comprising a base, a drain and a source, wherein each of the base of the secondary switching components is respectively connected to one of the other inputs of the fault detecting circuit, the source of a first one of the secondary switching components is grounded, the drain of the first one of the secondary switching components is connected to the source of a second one of the secondary switching components, and the drain of the last one of the secondary switching components is connected to the base of the primary switching component;

a bias resistor, connected between the base of the primary switching component and the power source; and a capacitor, connected between the base of the primary switching component and the ground; and a feedback control circuit, connected between the fault detecting circuit, the current balancing circuit and the power stage circuit, for controlling output of the power stage circuit according to the currents flowing through the light sources and the fault signal.

2. The light source driving device of claim 1, wherein the transformer and resonance circuit comprising:

a transformer comprising a primary winding and a secondary winding; and a resonance capacitor, connected between a high voltage end of the secondary winding and ground.

3. The light source driving device of claim 2, wherein high voltage ends of the light sources are jointly connected to the high voltage end of the secondary winding of the transformer.

4. The light source driving device of claim 3, wherein a low voltage end of the secondary winding of the transformer is grounded.

5. The light source driving device of claim 3, wherein the current balancing circuit comprises a plurality of windings respectively connected between low voltage ends of the corresponding lamps and the feedback control circuit.

6. The light source driving device of claim 1, wherein the fault detecting circuit comprising:

a diode, wherein an anode of the diode is connected to a low voltage end of one of the lamps;

a zener diode, wherein a cathode of the zener diode is connected to a cathode of the diode; and at least a resistor, connected between the anode of the zener diode and the base of the primary switching component.

7. A driving device for driving a plurality of light sources, comprising:

a power stage circuit electrically connected to said plurality of light sources for converting received signals of said power stage circuit to alternating current (AC) signals;

a transformer and resonance circuit electrically connected between said power stage circuit and said plurality of light sources for converting said AC signals from said power stage circuit to electrical signals adapted for driving said plurality of light sources respectively;

a current balancing circuit electrically connected to said plurality of light sources respectively at a side of said plurality of light sources opposite to said transformer and resonance circuit for balancing currents flowing through said plurality of light sources;

a fault detecting circuit comprising an input to electrically connect to a node located at an electrical connection between one of said plurality of light sources and said current balancing circuit for detecting any fault of said plurality of light sources, said fault detecting circuit comprising an output to provide an fault signal; and a feedback control circuit electrically connected between said output of said fault detecting circuit and said power stage circuit so as to control output of said power stage circuit according to said fault signal and further electrically connected between said current balancing circuit and said power stage circuit wherein said fault detecting circuit further comprises at least one other input to electrically connect to at least one node located at an electrical connection between said current balancing circuit and said feedback control circuit, said fault detecting circuit comprising:

a primary switching component comprising a base, a drain and a source, wherein said base of said primary switching component is electronically connected to said node located at said electrical connection between one of said plurality of light sources and said current balancing circuit, said drain of said primary switching component is connected to a power source, and said source of said primary switching component is defined as said output of said fault detecting circuit;

a plurality of secondary switching components each comprising a base, a drain and a source, wherein each of said base of said secondary switching components is respectively connected to one of said node located at said electrical connection between said current balancing circuit and said feedback control circuit, said source of a first one of said secondary switching components is grounded; said drain of said first one of said secondary switching components is connected to said source of a second one of said secondary switching components, and said drain of last one of the secondary switching components is connected to said base of said primary switching component;

a bias resistor, connected between said base of said primary switching component and said power source; and a capacitor, connected between said base of said primary switching component and said ground.

* * * * *